US006261739B1

(12) United States Patent
Ito et al.

(10) Patent No.: US 6,261,739 B1
(45) **Date of Patent: *Jul. 17, 2001**

(54) LASER ABLATIVE RECORDING MATERIAL

(75) Inventors: Tadashi Ito; Makoto Ishihara; Tatsuhiko Obayashi; Katsuyuki Watanabe, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/924,660

(22) Filed: Sep. 5, 1997

(30) Foreign Application Priority Data

| | | |
|---|---|---|
| Sep. 11, 1996 | (JP) | 8-240170 |
| Sep. 11, 1996 | (JP) | 8-240171 |
| Dec. 18, 1996 | (JP) | 8-338724 |

(51) Int. Cl.[7] ..... B41M 5/26

(52) U.S. Cl. ..... 430/270.11; 430/945; 430/200; 430/201; 524/716

(58) Field of Search ..... 430/945, 200, 430/201, 269, 270.11; 524/45, 716

(56) References Cited

U.S. PATENT DOCUMENTS

| | | | | |
|---|---|---|---|---|
| 3,787,210 | * | 1/1974 | Roberts | 430/201 |
| 3,962,513 | * | 6/1976 | Eames | 430/201 |
| 4,412,231 | * | 10/1983 | Namba et al. | 430/945 |
| 5,075,146 | * | 12/1991 | Satake et al. | 430/945 |
| 5,171,650 | * | 12/1992 | Ellis et al. | 430/201 |
| 5,330,876 | | 7/1994 | Kaszczuk et al. | 430/269 |
| 5,387,496 | * | 2/1995 | DeBoer | 430/201 |
| 5,401,618 | | 3/1995 | Chapman et al. | 430/330 |
| 5,459,017 | | 10/1995 | Topel, Jr. et al. | 430/269 |
| 5,501,940 | * | 3/1996 | Bloom et al. | 430/273.1 |
| 5,521,629 | | 5/1996 | DeBoer et al. | 347/262 |
| 5,529,884 | * | 6/1996 | Tutt et al. | 430/200 |
| 5,574,493 | | 11/1996 | Sanger et al. | 347/262 |
| 5,582,669 | * | 12/1996 | Gove et al. | 156/239 |
| 6,120,948 | * | 9/2000 | Ishihara | 430/201 |
| 6,124,075 | * | 9/2000 | Ishihara et al. | 430/200 |

FOREIGN PATENT DOCUMENTS

| | | | | |
|---|---|---|---|---|
| 0698503 | * | 2/1996 | (EP) . | |
| 2083726 | * | 3/1982 | (GB) . | |
| 7-041501 | * | 2/1995 | (JP) . | |
| 8-118812 | * | 5/1996 | (JP) . | |
| 9-025445 | * | 1/1997 | (JP) . | |
| WO 94/01280 | * | 1/1994 | (WO) | 430/201 |

OTHER PUBLICATIONS

Hamatsu, Takao, et al., "Charachtoristics and applications of novel cellulose derivatives, CNC", Kotingu Jiho, vol. 203, pp. 9–14, 1996.*

Hamatsu, Takao, et al., "Structure and Charachtoristics of cellulose nitrate carboxymethyl ether (CNC)", Kotingu Jiho, vol. 197, pp. 17–22, 1994.*

* cited by examiner

*Primary Examiner*—Martin Angebranndt
(74) *Attorney, Agent, or Firm*—Sughrue, Mion, Zinn, Macpeak & Seas, PLLC

(57) ABSTRACT

The present invention discloses a laser ablative recording material which has one or more layers including a coloring agent layer on a surface of a support, wherein at least one layer from among one or more layers including the coloring agent layer contains nitric acid ester of carboxyalkyl cellulose having a degree of nitric ester group substitution per glucose anhydride unit within a range of from 0.05 to 2.8; and at least one layer from among one or more layers including the coloring agent layer contains a material having absorption in the laser wavelength region. The laser ablative recording material of the invention is characterized by a small Dmin and a high removing efficiency of the image forming dyes.

8 Claims, No Drawings

LASER ABLATIVE RECORDING MATERIAL

BACKGROUND OF THE INVENTION

1. Field of the Invention

The present invention relates to a laser ablative recording material, and a laser ablative record of an image formed through imagewise heating of the laser ablative recording material.

2. Description of the Related Art

Recently, a thermal transfer system forming an image by imparting an electric signal to a thermal print head has become more popular. A method of forming an image by the use of a laser in place of the thermal print head was on the other hand developed, and is expected to become more popular along with the tendency toward a higher laser output.

A recording material for laser recording contains a material having a strong absorption in the laser wavelength region, and this absorbing material converts optical energy into thermal energy, and brings about effects similar to those available by the use of a thermal print head. Use of a laser, unlike the use of a thermal print head, permits heating without contact with a recording material, thus providing an advantage of the image surface free from flaws. Because of the possibility to stop down a laser beam, there is provided another advantage of improving image resolution.

A method for forming an image using a high-output laser known as the dye ablation has recently been developed. Japanese Unexamined Patent Publications Nos. 7-164,755, 7-149,063, and 7-149,065 (corresponding to U.S. Pat. Nos. 5,330,876, 5,401,618 and 5,459,017) disclose recording materials applicable in this method, and Japanese Unexamined Patent Publications Nos. 8-48,053 and 8-72,400 (corresponding to U.S. Pat. Nos. 5,521,629 and 5,574,493) disclose imaging apparatuses used in this method. Image recording based on the ablation method is accomplished by irradiating a laser from a dye layer side onto a recording material having a dye layer comprising an image dye, a material having absorption in the laser wavelength region (infrared-absorbing material) and a binder formed on a support. On the spot to which the laser beam has been irradiated, a sharp local change takes place in an image forming layer under the effect of energy from the laser, and this drives away the material from the layer. According to the aforesaid patent publications, this local change is not a perfectly physical change such as melting, evaporation or sublimation, but a kind of chemical change such as bond-breaking, and is believed to be a complete, not partial, removal of the image dye.

Usefulness of this dye ablation imaging method largely depends upon removal efficiency of the imaging dyes upon laser exposure. As a scale representing this efficiency, the minimum concentration value (Dmin) of the laser exposure portion is employed. A smaller value of Dmin is suggested to lead to a higher dye removing efficiency, and provision of a laser ablative recording material having a small Dmin is demanded for.

SUMMARY OF THE INVENTION

The present invention has an object to provide a laser ablative recording material having a small Dmin and a high removing efficiency of imaging dyes upon laser exposure. Another object of the invention is to provide a laser ablative recording material, of which Dmin is reduced without leading to a decrease in Dmax. Further another object of the invention is to provide a laser ablative recording material having a small Dmin, which permits easy handling upon manufacture and requires only a small consumption of an organic solvent. It is also an object of the present invention to provide a laser ablative recording material having a small Dmin, which ensures a high storage stability of an image formed through imagewise heating and easy handling with little image decoloration caused by, for example, finger prints, and the resultant image-formed laser ablative record. The other objects of the invention would be easily understood from the entire description of this specification by a person skilled in the art.

These objects are achieved by providing the present invention having the following contents.

The present invention provides a laser ablative recording material, having one or more layers including a coloring agent layer on a surface of a support, wherein at least one layer from among one or more layers including said coloring agent layer contains nitric acid ester of carboxyalkyl cellulose having a degree of nitric acid ester group substitution per glucose anhydride unit within a range of from 0.05 to 2.8, and wherein at least one layer from among one or more layers including said coloring agent layer contains a material having absorption in the laser wavelength region.

The present invention provides also a laser ablative image-formed record prepared by irradiating a laser onto the laser ablative recording material.

DESCRIPTION OF THE PREFERRED EMBODIMENTS

Now, the configuration and some preferred embodiments of the laser ablative recording material and the image-formed laser ablative record of the present invention will be described in detail below.

The laser ablative recording material of the present invention has a configuration in which one or more layers including a coloring agent layer (hereinafter referred to as the "layers on the coloring agent layer side") on a surface of a support. So far as the coloring agent layer is provided on a surface of the support, no other limitation is imposed on the layer configuration of the laser ablative recording material of the invention. Therefore, an intermediate layer may be provided between the coloring agent layer and the support. An overcoat layer may be provided on the coloring agent layer. Further, a primer layer may be provided for achieving a higher close contact between the intermediate layer and the support. The coloring agent layer, the intermediate layer, the overcoat layer and the primer layer may be single or multiple. One or more layers including a backcoat layer (hereinafter referred to as the "layers on the backcoat layer side") may be provided on the surface of the support opposite to the coloring agent layer.

In the laser ablative recording material of the invention, one or more kinds of nitric acid ester of carboxyalkyl cellulose are contained in at least one of the layers on the coloring agent layer side.

A nitric acid ester of carboxyalkyl cellulose is defined as part of hydroxide groups present in carboxyalkyl cellulose converted into a nitric acid ester. In the present invention, the nitric acid ester used should have a degree of nitric acid ester group substitution per glucose anhydride residue within a range of from 0.05 to 2.8. A degree of nitric acid ester group substitution of under 0.05 is not desirable because of insufficient dispersibility and water resistance of a developer and a dye. A degree of nitric acid ester group substitution of over 2.8 is not desirable because of the necessity of increasing the consumption of an organic solvent to dissolve or disperse the same in a mixed solvent of water and an organic solvent. The degree of nitric acid ester group substitution should more preferably be within a range of from 0.2 to 2.2.

Since nitric acid ester of carboxyalkyl cellulose having a degree of nitric acid ester group substitution within a range of from 0.05 to 2.8 is used in the present invention, it is possible to largely reduce the consumption of an organic solvent during manufacture of the laser ablative recording material. With a conventional recording material using a binder soluble only in an organic solvent such as cellulose nitrate, it is impossible to inhibit the organic solvent consumption. The high inflammability poses another problem of difficult handling during the coating step. Use of the nitric acid ester of carboxyalkyl cellulose permits resolution of these problems and allows to cope even with environmental problems.

Nitric ester of carboxyalkyl cellulose used in the invention should preferably have a degree of carboxyalkyl ether group substitution per glucose anhydride residue of over 0.05, or particularly preferably, from 0.05 to 1.5. A low degree of carboxyalkylether group substitution leads to an insufficient solubility in water, as to practical impossibility to use the same as a water-soluble binder. A high degree of carboxyalkyl tends in contrast to a slightly insufficient water resistance of the coated surface. It is therefore desirable to appropriately select a degree of carboxyalkylether group substitution in response to the purpose of use.

Nitric acid ester of carboxyalkyl cellulose used in the invention can be prepared through nitric-esterization by causing a reaction of carboxyalkyl cellulose with a mixed acid for nitric-esterization. A known reagent may be used as a mixed acid for nitric-esterization. For example, a mixed acid for nitric esterization comprising sulfuric acid, nitric acid and water may be used. Applicable carboxyalkyl cellulose include carboxymethyl cellulose and carboxyethyl cellulose.

Carboxyl group of nitric acid ester of carboxyalkyl cellulose used in the invention should preferably be partially or totally neutralized. Neutralization increases solubility into water and a water-soluble organic solvent mainly comprising water. For the purpose of neutralizing the carboxyl group, one or more of an alkali metal ion, an alkali earth metal ion, ammonium ion and a cation of an organic amine or the like may be used. The extent of neutralization, depending upon the chemical composition of the target solution including water and organic solvent contents, should preferably be in general such that 50% or more of carboxyl group are neutralized.

Nitric acid ester of carboxyalkyl cellulose used in the invention may have substitution groups other than nitric acid ester group or carboxyalkyl ether group, including, for example, methylether group, ethylether group, cyanoethylether group, hydroxyethylether group, hydroxypropylether group, acetic ester group, propionic ester group, and butyric ester group.

Actual examples, manufacturing methods and using methods in details of nitric acid ester of carboxyalkyl cellulose used in the invention are as disclosed in Japanese Unexamined Patent Publications Nos. 5-39,301 and 5-39,302 which are hereby incorporated by reference.

Nitric acid ester of carboxyalkyl cellulose may be appropriately used for any of the layers on the coloring agent layer side, including a coloring agent layer, an intermediate layer between a support and the coloring agent layer, and an overcoat layer on the coloring agent layer.

The amount of coated nitric acid ester of carboxyalkyl cellulose should preferably be within a range of from 0.05 to 5 g/m$^2$, or more preferably, of from 0.1 to 3 g/m$^2$.

In the recording material of the invention, a nitric acid ester of carboxyalkyl cellulose may be used either alone or in combination with at least one of known binders. It suffices that a nitric acid ester of carboxyalkyl cellulose is contained in at least one layer on the coloring agent layer side, and for the other layers, one of diverse and various binders capable of dispersing constituents of the layer may be employed.

Binders appropriately applicable for the laser ablative recording material of the invention include cellulose derivatives such as carboxymethyl cellulose and hydroxyethyl cellulose, and polymers such as polyvinyl alcohol, carboxydenatured polyvinyl alcohol, polyvinyl pyrrolidone, polyacrylic acid, polyacrylamide and gelatine, but are not limited to those enumerated above. Latex-based binders such as styrenebutadiene latex and urethane latex may also be used.

A decomposable polymer which are quickly pyrolized by heat generated from laser irradiation and gives a gas in a sufficient quantity and a volatile fragment, or a decomposable polymer of which the decomposition temperature considerably decreases in the present of a slight amount of an acid is also applicable. Preferable ones of such decomposable polymer include those having a polystyrene equivalent molecular weight of over 100,000 as measured by size-excluded chromatography disclosed in U.S. Pat. No. 5,330,876 which is hereby incorporated by reference (F. W. Billmeyer, "Textbook of Polymer Science", 2nd ed., 53–57).

One or more layers on the coloring agent layer side provided in the laser ablative recording material of the invention should contain a material having absorption within the wavelength region of the laser to be irradiated. The material having absorption in the laser wavelength region may be contained in the coloring agent layer, or in the intermediate layer present between the support and the coloring agent layer, or in the overcoat layer present on the coloring agent layer.

When the irradiated laser is an infrared laser, the material having absorption in the laser wavelength region should be an infrared-absorbing material. The amount of coated infrared-absorbing material should have a laser wavelength absorbance of over 0.5, or preferably, over 1.0, or more preferably, over 1.5. Applicable infrared-absorbing materials include, for example, carbon black, cyanic infrared-absorbing dye disclosed in U.S. Pat. No. 4,973,572, and materials disclosed in U.S. Pat. Nos. 4,948,777, 4,950,640, 4,950,639, 4,948,776, 4,948,778, 4,942,141, 4,952,552, 5,036,040, 4,912,083, 5,360,694, 5,380,635 and JPA No. 8-189,817. These patent publications are hereby incorporated by reference.

Typical examples of infrared-absorbing material suitably applicable for the laser ablative recording material of the invention are presented below. Infrared-absorbing materials applicable for the laser ablative recording material of the invention are not however limited to those enumerated below.

(1)

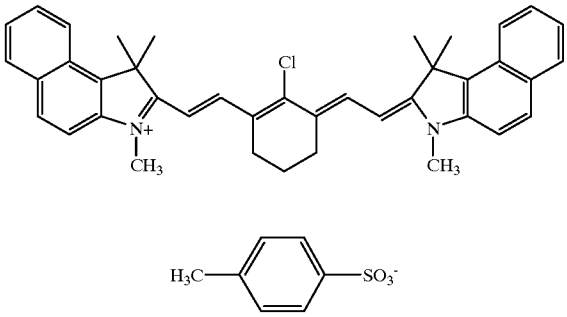

(2)

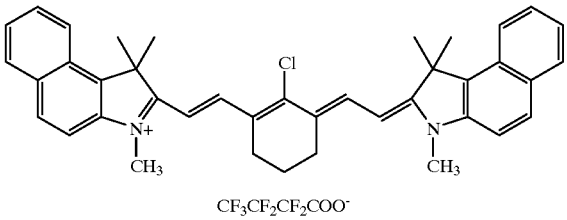

(3)

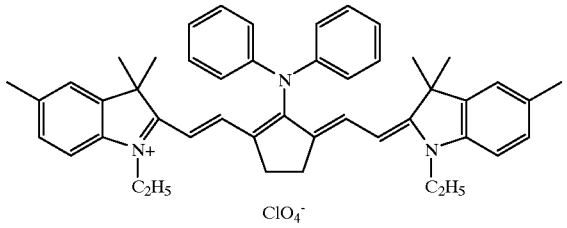

(4)

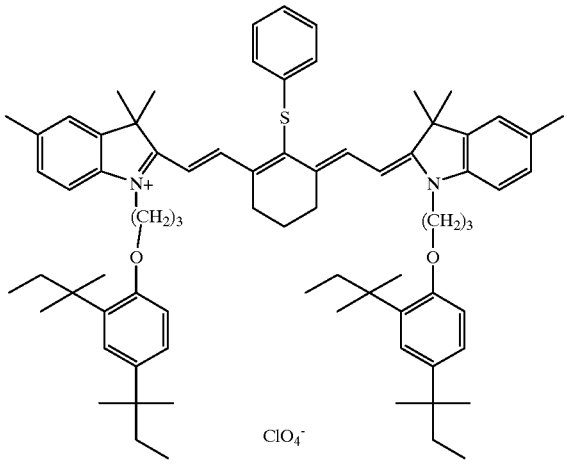

-continued (5)

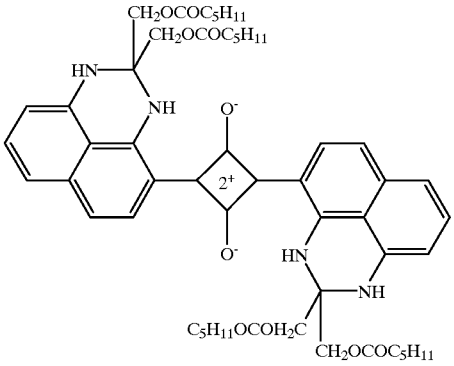

(6)

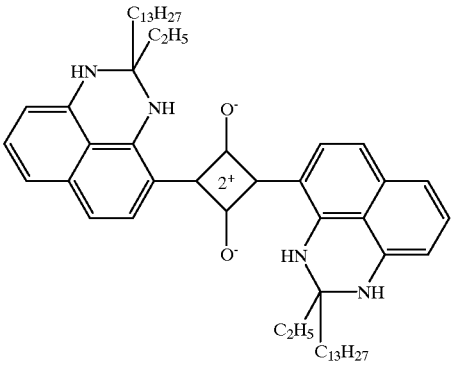

(7)

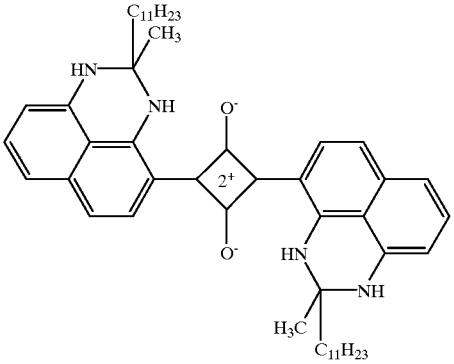

At least one coloring agent layer is provided in the recording material of the invention as described above. A pigment, an inorganic particulate or a dye is used as a coloring agent in the coloring agent layer. Preferable pigments and inorganic particulates include carbon black, graphite, titanium black, metal phthalocyanine, metal oxides such as titanium oxide, and colloidal silver.

When using the recording material for manufacturing a printing plate, the pigment or the inorganic particulate used is required to have absorption in the UV region. When it is used for medical purposes, the pigment or the inorganic particulate used should be black in color. The particle size which gives a color of the pigment or the inorganic particulate, which largely varies with circumstances, should preferably be within a range of from 5 to 500 nm, or more preferably, from 5 to 250 nm.

The amount of coated pigment or inorganic particulate should be within a range in which the laser non-irradiated portion has absorption of a concentration of over 2.5 (absorption value in the UV region for printing purposes, and absorption value in the visible region for medical purposes). In general, the coating amount varies with the kind or size of inorganic particulate used. For example, when coating carbon black (particle size: 24 nm) in a coating amount of 0.67 g/m$^2$, there are obtained a UV concentration of 4.0 and a visible concentration of 2.7. Coating of carbon black (primary particle size: 80 nm) in a coating amount of 0.5 g/m$^2$ results in a UV concentration of 4.2 and a visible concentration of 3.8. Colloidal silver (particle size: 20 nm), if coated in a coating amount of 0.5 g/m$^2$, leads to a UV concentration of 3.5 and a visible concentration of 0.4.

Use of a pigment or an inorganic particulate having absorption in the laser wavelength region is preferable because of the simultaneous availability of two functions including a laser wavelength absorbing material and a coloring agent. More specifically, this is favorable in that the necessity of individually preparing a laser wavelength absorbing material and a coloring agent is eliminated or alleviated.

There is no particular limitation imposed on the method of manufacturing a pigment or an inorganic particulate used in the invention so far as manufacture of the foregoing particle size is permitted. For example, the channel method, the thermal method and the furnace method disclosed in Donnel Voet, "Carbon Black" Marcel Dekker, Inc. (1976) are applicable for a carbon black material.

A dye of any kind may be used for the coloring agent layer of the invention so far as it permits ablation by laser irradiation. For example, dyes disclosed in U.S. Pat. Nos. 4,541,830, 4,698,651, 4,695,287, 4,701,439, 4,757,046, 4,743,582, 4,769,360, and 4,753,922, which are hereby incorporated by reference can by appropriately applied. These dyes may be used either alone or in combination. These dyes may be used in a coating amount within a range of from about 0.05 to about 1 g/m$^2$.

In the recording material of the invention, an overcoat layer may be provided for the purpose of imparting satisfactory scraping resistance, wear resistance and mat finish, as is disclosed in Japanese Unexamined Patent Publication No. 8-108,622 which is hereby incorporated by reference. Provision of the overcoat layer permits easy handling because of the slightest risk of discoloration of the formed image caused by finger prints or the like.

Beads may be contained in the overcoat layer. Particularly, polytetrafluoroethylene beads should preferably be contained. The particle size and the coating amount of polytetrafluoroethylene beads can be set within a range effective for achieving the intended object. In general, the particle size should preferably be within a range of from about 1 to about 100 $\mu$m, or more preferably, from about 3 to about 50 $\mu$m. The coating amount should be within a range of from about 0.005 to about 5.0 g/m$^2$, or more preferably, within a range of from about 0.05 to about 0.5 g/m$^2$. Polytetrafluoroethylene beads are not necessarily required to be in a spherical shape, but may be in any arbitrary shape.

As the binder of the overcoat layer containing beads, any arbitrary polymer may be used. More specifically, applicable polymers include cellulose derivatives such as cellulose nitrate, cellulose acetate hydrogen phthalate, cellulose acetate, cellulose acetate propionate, cellulose acetate butylate, cellulose triacetate, hydroxypropyl cellulose ether, ethyl cellulose ether, polycarbonate; polyurethane, polyester; poly(vinyl acetate); poly (vinyl halide) such as poly (vinyl chloride) and poly(vinyl chloride) copolymers; poly (vinyl ether); maleic acid anhydride copolymer; polystyrene; poly(styrene-co-acrylonitrile); polysulfon; poly (phenylene oxide); poly(ethylene oxide); poly(vinylalcohol-co-acetal) such as poly(vinyl acetal), poly(vinylacetal-co-butyral) and poly(vinylbenzal); and mixtures and copolymers thereof. The binder for the overcoat layer can be used in a coating amount within a range of from about 0.1 to about 5 g/m$^2$.

In the laser ablative recording material of the invention, an intermediate layer may be provided on the coloring agent layer side as described above. The intermediate layer may be provided between the support and the coloring agent layer, between a coloring agent layer and another coloring agent layer, or between the coloring agent layer and the overcoat layer.

When the intermediate layer is provided between the support and the coloring agent layer, the ablation efficiency can be increased and Dmin of the laser-irradiated portion can be reduced by adding cellulose nitrate in the intermediate layer. Cellulose nitrate may be contained in the intermediate layer either alone or in combination with another binder such as that used in the coloring agent layer or the overcoat layer. The amount of coated cellulose nitrate is not particularly limited so far as Dmin can be reduced, and should preferably be within a range of from 0.05 to 2 g/m$^2$, or more preferably, from 0.1 to 1.5 g/m$^2$. When the intermediate layer containing cellulose nitrate is to have a function of a primer layer to improve close contact with the support, the amount of coated cellulose nitrate should preferably be within a range of from 0.05 to 0.5 g/m$^2$.

A compound decomposed by heating and generating carbon dioxide, nitrogen or water may be contained in at least one layer on the coloring agent layer side provided in the laser ablative recording material of the invention. Containing this compound is desirable because of the effective reduction of Dmin. The compound generating carbon dioxide, nitrogen or water through decomposition by heating should preferably be contained in the coloring agent layer, the intermediate layer between the support and the coloring agent layer, or the overcoat layer, and particularly in the coloring agent layer or the intermediate layer. The coating amount is not particularly limited so far as Dmin at the laser-irradiated portion is reduced, and should preferably be within a range of from 0.05 to 10 m mol per m$^2$ of support, or more preferably, within a range of from 0.1 to 7.5 m mol.

A compound generating carbon dioxide by heating is a compound which has a structure comprising a bonding portion expressed as —$CO_2$— in the molecule, of which this bonding is broken by heating, thus generating carbon dioxide. Applicable compounds include electron-attracting group substituted acetic acids, malonic acids, oxamides, propionic acids, β-halo-cinnamic acids, α, β-epoxycarbonic acids, electron-attracting group substituted benzoic acids, polyhydroxy benzoic acids, amino-benzoic acids and other carbonic acids of which carbonate is removed by heating, metal salts and ammonium salts of these carbonic acids, lactones, carbonic esters, carbamates, and carbonates.

A compound generating nitrogen by heating is a compound having, in a molecule, a nitrogen-nitrogen bonding portion generating nitrogen upon heating and decomposition. Examples of such a compound include diazonium salts, diazo compounds, azo compounds, azide compounds, triazenes, tetrazols and hydrazines.

A compound generating water by heating is a compound having dehydrable hydroxide groups in the molecule or a compound containing water of crystallization. Examples of such a compound include alcohols, hydroxycarbonic acids, amino acids, dicarbonic acids, dicarbonic monoamides and compounds containing water of crystallization.

As a compound generating a gas by heating and decomposition, one decomposed at a temperature of over 50° C. is useful. When preservability is taken into account, a compound decomposed at a temperature within a range of from 100 to 500° C. is preferable, and one decomposed at a temperature within a range of from 150 to 300° C. is more preferable. Decomposability of these compounds may be measured by the use of an accelerated calorimeter (ARC), a differential scanning calorimeter (DCS) or a differential thermal analysis (DTA). These compounds generating a gas by heating and decomposition should preferably be ones not having absorption in a visible region of over 400 nm.

Now, typical compounds generating carbon dioxide, nitrogen or water through decomposition upon heating are enumerated below. The compound applicable in the invention is not however limited to those listed below.

(1)

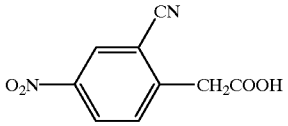

(2)

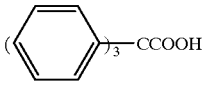

(3)

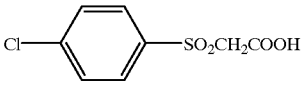

(4)

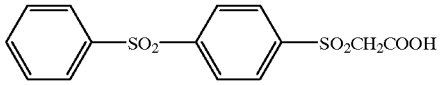

(5)

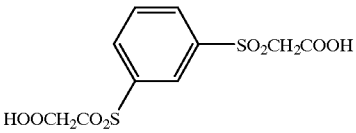

(6)

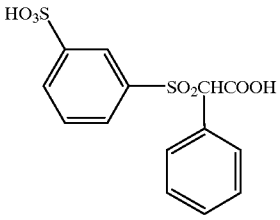

-continued (7)

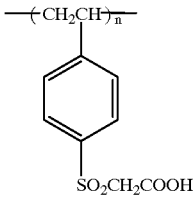

(8)

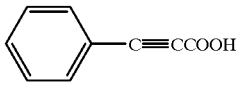

(9)

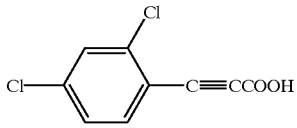

(10)

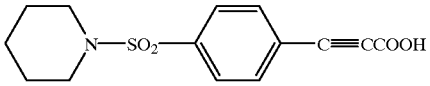

(11)

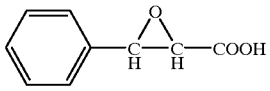

(12)

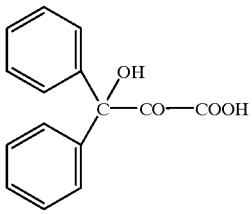

(13)

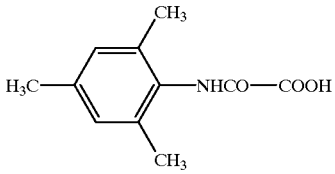

(14)

(15)

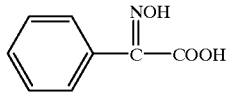

(16)

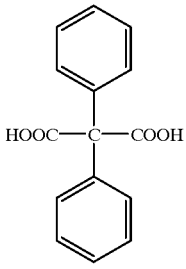

-continued
(17)
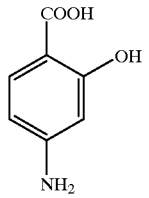
(18)
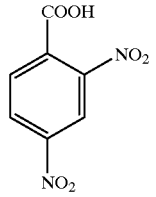
(19)
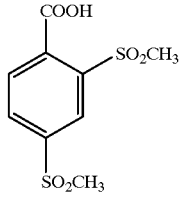
(20)
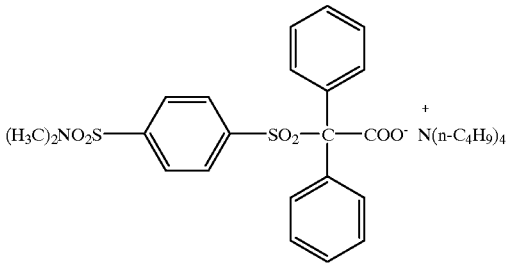
(21)
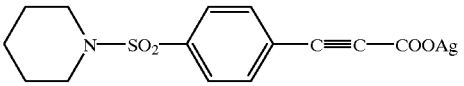
(22)
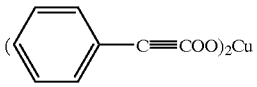
(23)
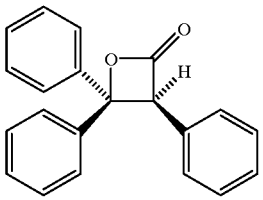
(24)
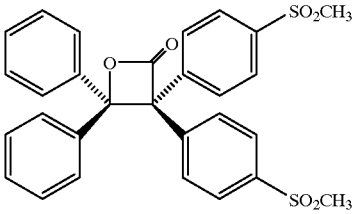
-continued
(25)
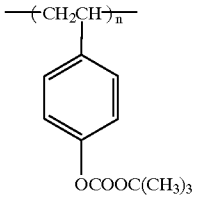
(26)
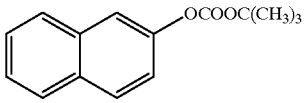
(27)
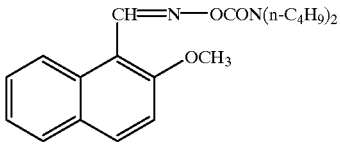
(28)
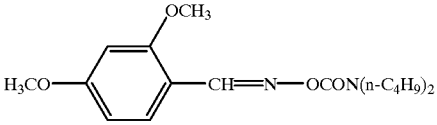
(29)
$NaHCO_3$
(30)
$K_2CO_3$
(31)
$(NH_4)_2CO_3$
(32)
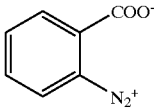
(33)
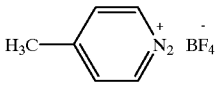
(34)
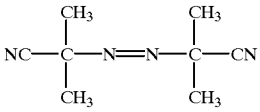
(35)
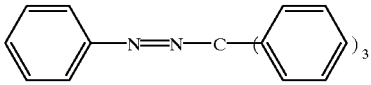
(36)
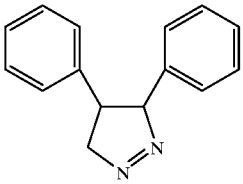

-continued
(37)
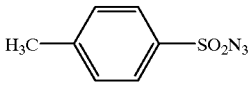
(38)
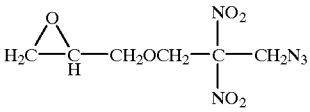
(39)
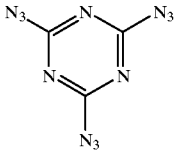
(40)
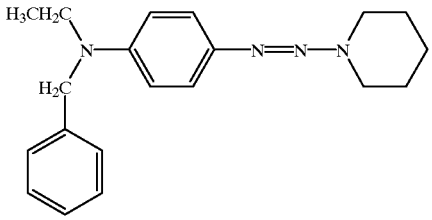
(41)
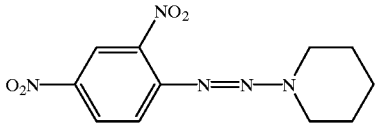
(42)
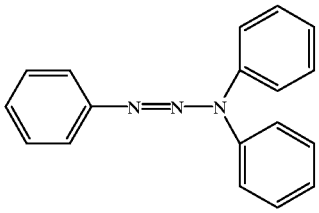
(43)
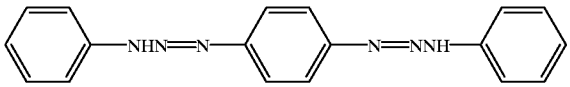
(44)
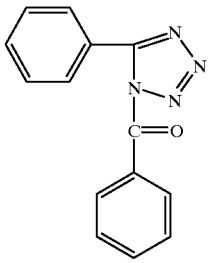
(45)
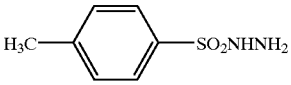
-continued
(46)
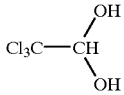
(47)
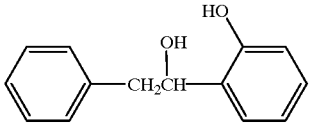
(48)
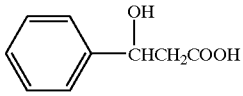
(49)
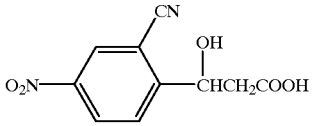
(50)
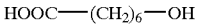
(51)
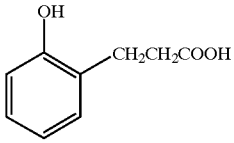
(52)
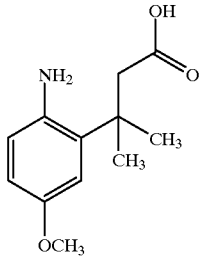
(53)
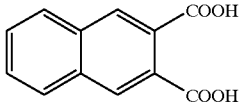
(54)
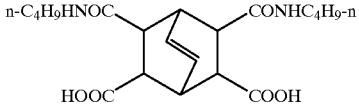
(55)
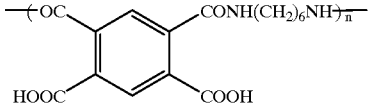
(56)
$CaCl_2 \cdot 6H_2O$
(57)
$MgCl_2 \cdot 6H_2O$ -continued (58)

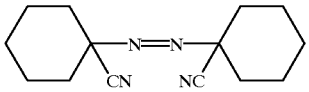

(59)

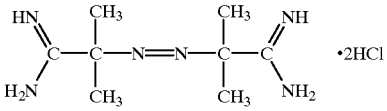

(60)

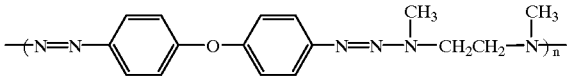

(61)

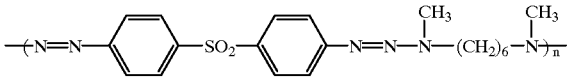

A backcoat layer may be provided in the laser ablative recording material of the invention. The backcoat layer may be formed on the surface of the support on the opposite side to the coloring agent layer.

From the point of view of adhesivity and strippability between recording materials, the outermost layer surface of the backcoat layer should preferably have a Beck smoothness of up to 4,000 seconds, or more preferably, within a range of from 10 to 4,000 seconds. Beck smoothness can be easily determined in accordance with the Japanese Industrial Standard (JIS) P8119 "Smoothness Testing Method of Paper and Cardboard by Beck Tester" and the TAPPI Standard Method T479.

Beck smoothness can be controlled by adjusting the average particle size and the quantity of addition of a matting agent to be contained in the overcoat layer of the backcoat layer. In the invention, the matting agent should preferably have an average particle size of up to 20 $\mu$m, or more preferably, within a range of from 0.4 to 10 $\mu$m. The quantity of added matting agent should preferably be within a range of from 0.5 to 400 mg/m$^2$, or more preferably, from 1.0 to 200 mg/m$^2$.

As the matting agent used in the invention, any solid particles may be used so far as they do not cause a problem in handling, and may be either inorganic or organic. Examples of inorganic matting agent include silicon dioxide, titanium and aluminum oxides, zinc and calcium carbonates, barium and calcium sulfates, and calcium and aluminum silicates. Applicable organic matting agents include organic polymers such as cellulose esters, polymethylmethacrylate, polystyrene and polydivinylbenzene and copolymers thereof.

In the invention, it is desirable to use a porous matting agent disclosed in Japanese Unexamined Patent Publication No. 3-109,542, page 2, left lower column, line 8 through page 3, right upper column, line 4 an alkali surface-modifying matting agent disclosed in Japanese Unexamined Patent Publication No. 4-127,142, page 3, right upper column, line 7 through page 5, right lower column, line 4, or an organic polymer matting agent 11 disclosed in Japanese Patent Application No. 4-265,962, paragraph Nos. [0005] to [00261. ]These patent publications and application are hereby incorporated by reference.

These matting agents may be used either alone or two or more thereof in combination. Manners of simultaneous use of two or more matting agents include simultaneous use of an inorganic matting agent and an organic matting agent, simultaneous use of a porous matting agent and a non-porous matting agent, simultaneous use of an amorphous matting agent and a spherical matting agent, and simultaneous use of matting agents with different average particle sizes (for example, simultaneous use of a matting agent having an average particle size of at least 1.5 $\mu$m disclosed in Japanese Patent Application No. 4-265,962 which is hereby incorporated by reference and a matting agent having an average particle size of up to 1 $\mu$m).

A conductive layer having a surface resistance of up to $10^{12}\Omega$ at 25° C. and 30% RH may be provided in the recording material of the invention. The conductive layer may be provided either on the coloring agent layer side of the support or on the backcoat layer side. A single conductive layer or two or more such layers may be provided. Further, the conductive layer may be prepared by adding a conductive material to a layer having other functions such as a surface protecting layer, a backcoat layer or a primer layer.

The conductive layer can be formed by coating a coating solution containing a conductive metal oxide or a conductive polymeric compound.

As a conductive metal oxide, it is desirable to use crystalline metal oxide particles. Among others, a particularly preferable one is a conductive metal oxide containing an oxygen defect or containing exotic atom in a slight amount, which forms a donor to the metal oxide used, which has in general a high conductivity. Applicable metal oxides include ZnO, $TiO_2$, $SnO_2$, $Al_2O_3$, $In_2O_3$, $SiO_2$, MgO, BaO, $MoO_3$ and $V_2O_5$ and composite oxides thereof Particularly, ZnO, $TiO_2$ and $SnO_2$ are preferable. Effective examples containing an exotic atom include ZnO containing added Al, In or the like, $SnO_2$ containing added Sb, Nb or a halogen element, and $TiO_2$ containing added Nb, Ta or the like. The quantity of addition of the exotic atom in these cases should preferably be within a range of from 0.01 to 30 mol %, or more preferably, from 0.1 to 10 mol %.

The metal oxide particulate used in the invention should preferably be conductive and have a volume resistivity of up to $10^7$ Ω.cm, or more preferably, up to $10^5$ Ω.cm. These oxides are disclosed in Japanese Unexamined Patent Publications Nos. 56-143,431, 56-120,519 and 58-62,647 which are hereby incorporated by reference.

A conductive material prepared by causing the aforesaid metal oxides to adhere to other crystalline metal oxide particles or a fibrous material (titanium oxide, for example) may also be used, as is disclosed in Japanese Examined Patent Publication No. 59-6,235 which is hereby incorporated by reference.

The conductive material used in the invention should preferably have a particle size of up to 10 $\mu$m, or more preferably, up to 2 $\mu$m with a view to ensuring stability after dispersion. In order to achieve the lowest possible light scattering, it is desirable to use conductive particles having a particles size of up to 0.5 $\mu$m. Use of such conductive particles permits maintenance of transparency of the support by providing a conductive layer.

When the conductive material is acicular-shaped or fibrous, the material should preferably have a length of up to 30 $\mu$m and a diameter of up to 2 $\mu$m, or more preferably, a length of up to 25 $\mu$m and a diameter of up to 0.5 $\mu$m, with a length/diameter ratio of at least 3.

Preferable conductive polymeric compounds applicable in the invention include polyvinylbenzenesulfonic salts, polyvinylbenziltrimethylammonium chloride, grade-4 polymers as disclosed in U.S. Pat. Nos. 4,108,802, 4,118,231, 4,126,467, and 4,137,217 which are hereby incorporated by reference, and polymer latexes as disclosed in U.S. Pat. No. 4,070,189, West German Unexamined Patent Publication No. 2,830,767, Japanese Unexamined Patent Publications Nos. 61-296,352 and 61-62,033.

Some concrete examples of the conductive polymeric compound of the invention are enumerated below. Conductive materials applicable in the invention are not however limited to those presented below. The composition of the following polymers is expressed in percentage of polymerization.

E-1

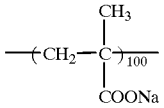

E-2

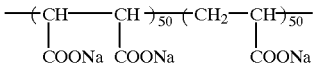

E-3

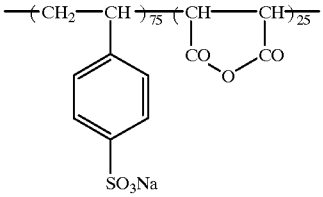

E-4

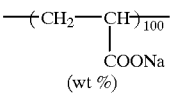

(wt %)

E-5

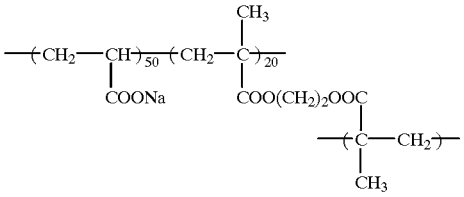

E-6

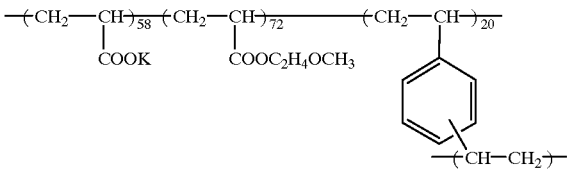

E-7

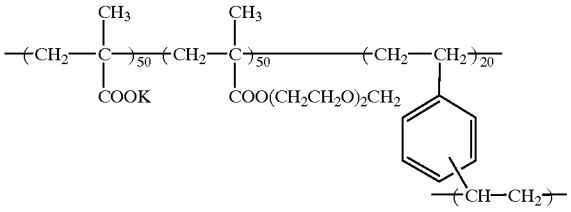

The conductive metal oxide or the conductive polymeric compound is used for forming a conductive layer after dispersing or dissolving in a binder.

The binder used for dispersing or dissolving the conductive metal oxide or the conductive polymeric compound is not particularly limited so far as a film-forming ability is available. For example, applicable binders include protein such as gelatine and casein, cellulose compounds such as carboxymethyl cellulose, hydroxyethyl cellulose, acetyl cellulose, diacetyl cellulose, and triacetyl cellulose, dextran, agar, soda alginate, saccharides such as starch derivatives, and synthetic polymers such as polyvinyl alcohol, polyvinyl acetate, polyacrylic ester, polymethacrylic ester, polystyrene, polyacrylamide, poly-N-vinylpyrrolidone, polyester, polyvinyl chloride, and polyacrylic acid.

Particularly preferable ones include gelatine (lime-treated gelatine, acid-treated gelatine, enzyme-decomposed gelatine, phthalized gelatine, acetylated gelatine, etc.), acetylcellulose, diacetylcellulose, triacetylcellulose, polyvinyl acetate, polyvinyl alcohol, polyacrylic butyl, polyacrylamide, and dextran.

In order to effectively reduce resistance of the conductive layer, a higher volume content of the conductive metal oxide or the conductive polymeric compound is more preferable. However, a binder content of under 5% leads to a lower strength of the conductive layer, and is therefore undesirable. The volume content of the conductive metal oxide or the conductive polymeric compound should therefore preferably be set within a range of from 5 to 95%.

The consumption of the conductive metal oxide or the conductive polymeric compound per $m^2$ of the recording material of the invention should preferably be within a range of from 0.05 to 20 $g/m^2$, or more preferably, from 0.1 to 10 $g/m^2$. To impart a satisfactory antistatic property, the surface resistivity of the conductive layer should be up to $10^{12}\Omega$ under conditions including 25° C. and 30% RH, or more preferably, up to $10^{11}\Omega$.

A better antistatic property can be imparted by simultaneously using a fluorine-containing surfactant in addition to the foregoing conductive material. The fluorine-containing surfactant used in the conductive layer may be the same as the above-mentioned fluorine-containing surfactant, or different therefrom. As the fluorine-containing surfactant used in the conductive layer, a surfactant may have a fluoroalkyl group, an alkenyl group or an aryl group having a carbon number of at least 4, and as an ionic group, an anion group (sulfonic acid (salt), sulfuric acid (salt), carboxylic acid (salt), phosphoric acid (salt)) a cation group (amine salt, ammonium salt, aromatic amine salt, sulfonium salt, phosphonium salt), betaine group (carboxyamine salt, carboxyammonium salt, sulfoamine salt, sulfoammonium salt, phosphoammonium salt) or a nonion group (substituted, non-substituted polyoxyalkylene group, polyglyceril group or sorbitan residue). These fluorine-containing surfactants are disclosed in Japanese Unexamined Patent Publication No. 49-10,722, British Patent No. 1,330,356, U.S. Pat. Nos. 4,335,201, 4,347,308, B.P. No. 1,417,915, Japanese Unexamined Patent Publication No. 55-149,938, 58-196,544, and B.P. No. 1,439,402 which are hereby incorporated by reference.

Examples of the fluorine-containing surfactant applicable in the conductive layer are enumerated below.

F-1

F-2

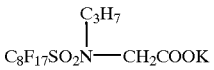

-continued

F-3

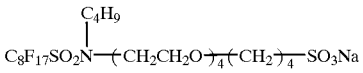

F-4

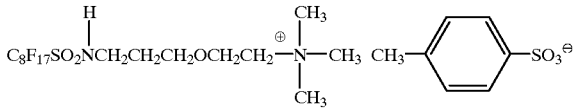

As the support in the recording material of the invention, any material may be used so far as it has a size stability and can withstand heat produced by laser irradiation. Materials applicable as a support include polyesters such as poly (ethylene naphthalate) and poly (ethylene terephthalate); polyamide; polycarbonate; cellulose esters such as cellulose acetate; fluoro-polymers such as poly(vinylidene fluoride) and poly(tetrafluoro-ethylene-co-hexafluoropropylene; polyethers such as polyoxymethylene; polyacetal; polyolefins such as plystyrene, polyethylene, polypropylene and methylpentenpolymer; and polyimides such as polyimide and polyetherimide. The thickness of the support, not particularly limited, should usually be within a range of from about 5 to about 200 $\mu$m.

As required, a primer layer as disclosed in U.S. Pat. Nos. 4,695,288 and 4,737,486, which are hereby incorporated by reference, may be coated onto the support.

An image can be recorded on the recording material of the invention in accordance with an ordinary laser ablation recording method.

In the present invention, laser irradiation is preferably accomplished from the coloring agent layer side since image forming based on the single sheet method is possible without the necessity of a receiving material.

The ablative recording material of the invention should have a Dmin of up to 0.11 after laser irradiation, as is described in Japanese Unexamined Patent Publication No.8-48,053. With a Dmin of up to 0.11, a luster line recognizable by naked eyes is largely eliminated. In order to achieve a Dmin of up to 0.11, the laser beam intensity for writing produced by the laser diode onto the recording material should preferably be at least 0.1 mW/$\mu$m$^2$.

In order to form a laser ablative image on the recording material of the invention, it is desirable to use an infrared diode laser having light emission at above 700 nm. Such a diode laser has practical advantages in that it is compact in size, low in cost, has high stability and reliability, is robust and permits easy modulation.

Laser ablation recording onto the recording material of the invention can be conducted with the use of a commercially available laser irradiating apparatus. Applicable such apparatuses include the laser model SDL-2420-H2 of Spectra Diode Labs., and the laser model SLD304 V/W of Sony Corporation).

When a laser is irradiated onto the recording material of the invention, the material is partially ablated from the support and is scattered into the surrounding open air. The ablated material may gather around the laser apparatus, or accumulate on the portion written with laser. This dump shuts off the laser beam, causes Dmin to increase over the allowable level, and may thus make the image quality degraded to become impracticable. To cope with such a problem, it is desirable to simultaneously use an apparatus for removing the ablated material with an air flow. An example of such a removing apparatus is disclosed in Japanese Unexamined Patent Publication No. 8-72,400 which is hereby incorporated by reference.

A laser ablative record with an image formed by laser irradiation onto the recording material of the invention should preferably be subjected to a treatment for increasing durability of the image. For example, a protecting layer may be formed on the surface of the coloring agent layer side for the protection of the image.

The protecting layer may be formed by the use of an image protecting laminated sheet disclosed in Japanese Unexamined Patent Publication Nos. 5-504,008 and 6-344,676, which are hereby incorporated by reference. This image protecting laminated sheet has a support and a substantially transparent and wear-resistant withstanding layer (protecting layer), and the support and the withstanding layer are bonded together by a weak bonding layer formed therebetween. In application, the withstanding layer of the image protecting laminated sheet is first placed face to face with the image of the recording material, and after bonding of the surfaces of the withstanding layer and the recording material, the support of the image protecting laminated sheet is stripped off. By doing so, a withstanding layer is formed on the surface of the recording material and plays a role of a protecting layer. Particularly, when adopting the protecting layer forming method disclosed in Japanese Unexamined Patent Publication No. 6-344,676 which is hereby incorporated by reference, the protecting layer never peels off even by repeatedly using a strong adhesive tape upon printing or repeatedly washing the image.

A typical example of the material for the protecting layer used in the invention is a polymeric organic material containing siloxane as disclosed in Japanese Unexamined Patent Publication No. 6-344,676 which is hereby incorporated by reference. A siloxane-containing polymeric material can be prepared, for example, through co-polymerization of an organic monomer or oligomer functionalized with a vinylether group and a siloxane monomer or oligomer. One prepared by any other method is also applicable. The protecting layer on the image has usually a thickness of up to 30 $\mu$m, and in order to prevent an excessive decrease in resolution, the thickness should preferably be up to 10 $\mu$m, or more preferably, within a range of from 0.5 to 6 $\mu$m.

The laser ablative record having an image formed by irradiating a laser onto the recording material of the invention may be stored or used directly for record, or used as a printing plate for printing purposes or as a film for printing. The areas of application thereof widely cover diverse and various fields including press printing, printing for facsimile output, various commercial prints, and medical images. Either a positive or a negative image may be selected and formed on the recording material of the invention in response to the purpose of use, A person skilled in the art could appropriately select a support of the recording material and a material for the coloring agent for the recording material of the invention, depending upon a particular object of application.

EXAMPLES

Now, the present invention will be described further in detail by means of examples. The chemical compositions, the ratios and the procedures shown in the following examples may be appropriately modified within the scope not deviating from the spirit of the present invention. The scope of the present invention is not therefore limited by the following examples.

A binder solution A used in this example is a 15% solution of nitric acid ester of carboxymethyl cellulose (butyl cellulose: 10%; water: 75%; pH adjusted to 6.4 by the use of ammonia water) having a degree of nitric acid ester group substitution of 1.9 and a degree of carboxymethylether group substitution of 0.6 per unit of glucose anhydride.

A binder solution B used in this example is a 15% solution of nitric acid ester of carboxymethyl cellulose (isopropyl alcohol: 25%; water: 60%; pH adjusted to 7.2 by the use of ammonia water) having a degree of nitric acid ester group substitution of 1.0 and a degree of carboxymethylether group substitution of 0.7 per unit of glucose anhydride.

A core-shell type vinylidene chloride copolymer, compounds A to E and surfactants 1 and 2 used in the present example represent the following compounds:

Core-shell type vinylidene chloride copolymer

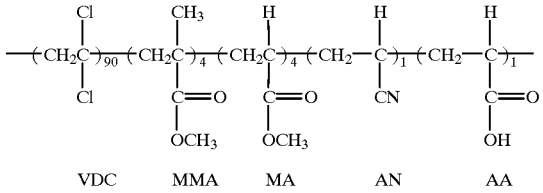

Core: VDC/MMA/MA (80 wt %)
Shell: VDC/AN/AA (20 wt %)
average particle size: 70nm Compound A

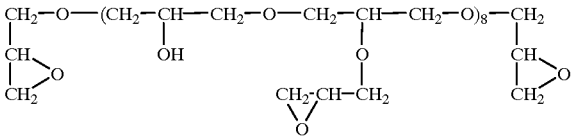

Compound B

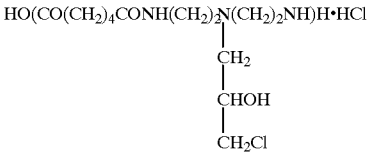

Compound C

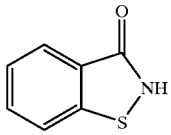

Compound D

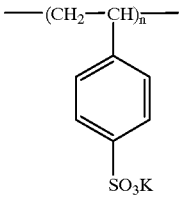

Compound E (1)/(2) = 4/1

(1)

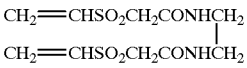

-continued (2)

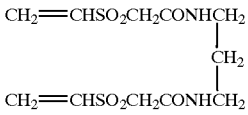

Surfactant 1

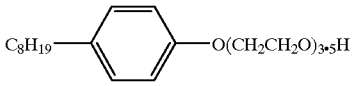

Surfactant 2

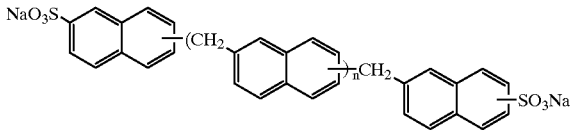

n = 2~3

<Coating of Back Primer Layer>

The value of pH was adjusted to 6 by mixing the constituents of the first primer coating solution shown below and adding 10 wt. % KOH. The resultant first primer layer coating solution was two-dimensionally stretched out and coated onto one surface of a polyethylene terephthalate support (thickness: 100 μm) both sides of which were glow-discharged-treated. The coated surface was then dried at 180° C. for two minutes to prepare a first primer layer having a dried thickness of 0.9 μm. A second primer layer coating solution having the following chemical composition was coated onto the first primer layer, and the coating was dried at 170° C. for two minutes to prepare a second primer layer having a dried thickness of 0.1 μm.

TABLE 1

Chemical composition of coating solution of first primer layer

| Constituent | Weight parts |
|---|---|
| Core-shell type vinylidene chloride copolymer | 15 |
| 2,4-dichloro-6-hydroxy-s-triazine | 0.25 |
| Polystyrene particulate (average particle size: 3 μm) | 0.05 |
| Compound A | 0.20 |
| Colloidal silica (Snowtex ZL; particle size: 70–100 μm; made by Nissan Kagaku Co.) | 0.12 |
| Water | Balance |
| (Total) | 100 |

TABLE 2

Chemical composition of coating solution of second primer layer

| Constituent | Weight parts |
|---|---|
| Gelatine | 1 |
| Methyl cellulose | 0.05 |
| Compound B | 0.02 |
| $C_{12}H_{25}O(CH_2CH_2O)_{10}H$ | 0.03 |
| Compound C | $3.5 \times 10^{-3}$ |
| Acetic acid | 0.2 |
| Water | Balance |
| (Total) | 100 |

<Coating of Conductive Layer and Back Layer>

A conductive layer coating solution and a backcoat layer coating solution having the following chemical compositions were simultaneously coated on the second primer layer. Gelatine was coated in amounts of 0.06 g/m$^2$ and 0.3 g/m$^2$, respectively for the conductive layer and the backcoat layer. The thus prepared backcoat layer had a Beck smoothness of 500 seconds.

TABLE 3

Chemical composition of coating solution of conductive layer

| Constituent | Weight parts |
|---|---|
| $SnO_2$/Sb (weight ratio: 9/1; average particle size: 0.25 μm) | 186 |
| Gelatine (Ca content: 3,000 ppm) | 60 |
| p-dodecylbenzene sodium sulfonate | 13 |
| Dihexyl- α -sodium sulfosuccinate | 12 |
| Compound D | 12 |
| Compound C | 1 |

TABLE 4

Chemical composition of coating solution of back layer

| Constituent | Weight parts |
|---|---|
| Gelatine (Ca content: 30 ppm) | 0.3 |
| Polymethylmethacrylate particulate (average particle size: 4.7 μm) | 3 |
| Compound C | 0.5 |
| p-dodecylbenzene sodium sulfonate | 10 |
| Dihexyl- α -sodium sulfosccinate | 3 |
| $C_8H_{17}SO_3Li$ | 0.5 |
| N-perfluorooctanesulfonyl-N-propylglycinepotadium | 6 |
| Sodium sulfate | 27 |
| Sodium acetate | 6 |
| Compound E (film hardening agent) | Amount giving a water swelling ratio of 90% |

<Coating of Intermediate Layers>

Any one of intermediate layer coating solutions having the following chemical compositions was coated onto the surface of the support opposite to the back layer.

For an intermediate layer 1, the solution was coated in a coating amount of polyvinylbutyral of 0.25 g/m$^2$; for an intermediate layer 2, the solution was coated in a coating amount of polyvinyl alcohol of 0.25 g/m$^2$; for intermediate layers 3 and 6, the solution was coated in a coating amount of nitric acid ester of carboxymethyl cellulose of 0.25 g/m$^2$; for intermediate layers 4 and 5, the solution was coated in a coating amount of cellulose nitrate of 0.25 g/m$^2$; for an intermediate layer 7, the solution was coated in a coating amount of nitric acid ester of carboxymethyl cellulose of 0.125 g/m$^2$; and for an intermediate layer 8, the solution was coated in a coating amount of cellulose nitrate of 0.125 g/m$^2$.

TABLE 5

Chemical composition of coating solution of intermediate layer

| Intermediate layer | Constituent | Weight parts |
|---|---|---|
| 1 | Polyvinyl butyral (Butvar B76; made by Monsant Co.) | 1.73 |
| | Methylethyl ketone | 29.2 |
| | Toluene | 5.48 |
| 2 | Polyvinyl alcohol (PVA-405; made by Kuraray Co.) | 0.86 |
| | Surfactant 1 | 0.63 |
| | Water | 34.5 |
| 3 | Binder A solution | 11.5 |
| | Butylcellosolve | 9.19 |
| | Water | 15.3 |

TABLE 5-continued

Chemical composition of coating solution of intermediate layer

| Intermediate layer | Constituent | Weight parts |
|---|---|---|
| 4 | Cellulose nitrate (RS: 1,000 sec.; made by Daiseru Kagaku Kogyo Co.) | 1.73 |
| | Methylethyl ketone | 28.7 |
| | Toluene | 5.48 |
| | Isopropyl alcohol | 0.52 |
| 5 | Cellulose nitrate (RS: ½ sec.; made by Daiseru Kagaku Kogyo Co.) | 1.73 |
| | Methylethyl ketone | 28.7 |
| | Toluene | 5.48 |
| | Isopropyl alcohol | 0.52 |
| 6 | Binder A solution | 11.5 |
| | Butylcellosolve | 9.19 |
| | Water | 15.3 |
| | Infrared-absorbing material (1) | 0.345 |
| 7 | Binder A solution | 11.5 |
| | Butylcellosolve | 9.19 |
| | Water | 15.3 |
| | Infrared-absorbing material (1) | 0.69 |
| 8 | Cellulose nitrate (RS: ½ sec.; made by Daiseru Kagaku Kogyo Co.) | 1.73 |
| | Methylethyl ketone | 28.7 |
| | Toluene | 5.48 |
| | Isopropyl alcohol | 0.52 |
| | Infrared-absorbing material (1) | 0.692 |

<Coating of Coloring Agent Layer>

Any one of coloring agent layer coating solutions prepared by uniformly dispersing individual mixtures of the following chemical compositions was coated onto the intermediate layer in a coating amount of carbon black of 0.67 g/m$^2$.

TABLE 6

Chemical composition of coating solution of coloring agent layer

| Coloring agent layer | Constituent | Weight parts |
|---|---|---|
| 1 | Binder A solution | 33.3 |
| | Butylcellosolve | 7.34 |
| | Water | 55.1 |
| | Solspers S20000 (made by Zeneca Co.) | 1.35 |
| | Solspers S12000 (made by Zeneca Co.) | 0.23 |
| | Carbon black (article size: 24 nm) | 5 |
| 2 | Binder B solution | 33.3 |
| | Isopropyl alcohol | 18.4 |
| | Water | 44.O |
| | Solspers S20000 (made by Zeneca Co.) | 1.35 |
| | Solspers S12000 (made by Zeneca Co.) | 0.23 |
| | Carbon black (particle size: 24 nm) | 5 |
| 3 | Cellulose nitrate (RS: ½ sec.; made by Daisery Kagaku Kogyo Co.) | 5 |
| | Isopropyl alcohol | 2.14 |
| | Methylisobutyl ketone | 26.6 |
| | Methylethyl ketone | 62.O |
| | Solspers S20000 (made by Zeneca Co.) | 1.35 |
| | Solspers S12000 (made by Zeneca Co.) | 0.23 |
| | Carbon black (particle size: 24 nm) | 5 |
| 4 | Polyvinyl alcohol (PVA-405; made by Kuraray Co.) | 5 |
| | Water | 91.5 |
| | Surfactant 2 | 0.75 |
| | Carbon black (particle size: 24 nm) | 5 |

<Coating of Overcoat Layer>

Any one of overcoat layer coating solutions having the following chemical compositions was coated onto the coloring agent layer.

For an overcoat layer 1, the solution was coated in a coating amount of polyvinyl alcohol of 0.5 g/m$^2$; for an overcoat layer 2, the solution was coated in a coating amount of nitric acid ester of carboxymethyl cellulose of 0.5 g/m$^2$; and for an overcoat layer 3, the solution was coated in a coating amount of nitric acid ester of carboxymethyl cellulose of 0.2 g/m$^2$.

TABLE 7

Chemical composition of coating solution of overcoat layer

| Overcoat Layer | Contents | Weight parts |
|---|---|---|
| 1 | Polyvinyl alcohol (PVA-405; made by Kuraray Co.) | 0.86 |
| | Surfactant 1 | 0.63 |
| | Water | 34.5 |
| 2 | Binder B solution | 5.75 |
| | Isopropyl alcohol | 4.60 |
| | Water | 19.7 |
| 3 | Nitric acid ester of carboxymethyl cellulose (degree of nitric acid ester group substitution per glucose anhydride unit: 1.0; degree of carboxymethylether group substitution: 0.7) | 0.2 |
| | Polytetrafluorosthylene beads (particle size: 2 μm) | 0.15 |
| | Nonylphenoxypolyglycidol | 0.02 |

Combination of the intermediate layer, the coloring agent layer and the overcoat layer for the individual samples are as shown in Table 8.

<Exposure Conditions for Image Recording>

Each sample was fixed, with the coloring agent layer side directed outside, to a drum of an image exposure apparatus similar to that disclosed in Japanese Unexamined Patent Publication No. 8-48,053. By the use of a diode laser (SDL-2430; wavelength range: 800 to 830 nm; made by Spectra Diode Labs.) and a lens mounted on a travelling stage of the apparatus, the focus of the laser was aligned with the sample surface (spot size: 10 μm; half-value width: 7 μm; focal output: 100 mW). The amount of irradiation on the sample surface was set at 700 mJ/cm$^2$ by adjusting the drum revolutions of the image exposure apparatus. The diode laser mounted on the travelling stage was caused to travel at a speed leading to a center distance of the irradiated beams of 7 μm.

Carbon black and binder ablated by the laser was efficiently removed from the sample surface by blowing an air flow during laser irradiation by the use of an apparatus similar to that disclosed in Japanese Unexamined Patent Publication No. 8-72,400.

<Evaluation of Dmax and Dmin in UV Region>

Concentration at the laser-non-irradiated portion and the irradiated portion was measured by means of a densitometer using a UV filter (TD904; made by Macbeth Co.), and the respective measured values were recorded as Dmax (maximum concentration) and Dmin (minimum concentration) in the UV region. The results are as shown in the table below.

TABLE 8

Test results

| Sample No. | Intermediate layer No. | Coloring agent layer No. | Overcoat layer No. | Dmax | Dmin |
|---|---|---|---|---|---|
| 1 | 1 | 4 | 1 | 4.0 | 0.36 |
| 2 | 2 | 4 | 1 | 4.0 | 0.38 |
| 3(present inv.) | 3 | 4 | 1 | 4.0 | 0.09 |
| 4 | 4 | 4 | 1 | 4.0 | 0.10 |
| 5 | 5 | 4 | 1 | 4.0 | 0.09 |
| 6(present inv.) | 6 | 4 | 1 | 4.0 | 0.08 |
| 7(present inv.) | 7 | 4 | 1 | 4.0 | 0.08 |
| 8 | 8 | 4 | 1 | 4.0 | 0.08 |
| 9(present inv.) | — | 1 | 1 | 4.0 | 0.08 |
| 10(present inv.) | — | 2 | 1 | 4.0 | 0.08 |
| 11 | — | 3 | 1 | 3.7 | 0.08 |
| 12 | — | 4 | 1 | 4.0 | 0.42 |
| 13(present inv.) | — | 1 | 2 | 4.0 | 0.07 |
| 14(present inv.) | — | 2 | 2 | 4.0 | 0.07 |
| 15(present inv.) | 7 | 1 | 2 | 4.0 | 0.06 |
| 16(present inv.) | 8 | 3 | 2 | 3.7 | 0.06 |
| 17(present inv.) | 7 | 3 | 2 | 3.7 | 0.06 |
| 18(present inv.) | 8 | 3 | 2 | 3.7 | 0.06 |
| 19(present inv.) | 7 | 1 | 3 | 4.0 | 0.06 |
| 20(present inv.) | 7 | 3 | 3 | 4.0 | 0.06 |

Table 8 suggests that the samples of the invention using nitric acid ester of carboxyalkyl cellulose are excellent in Dmin. The samples 4, 5 and 11 using cellulose nitrate in place of nitric acid ester of carboxyalkyl cellulose are not desirable in terms of environment because of the necessity of an organic solvent in a large quantity during manufacture, although Dmin values are low. The laser ablative recording material of the invention is thus excellent in that an organic solvent in a large quantity is not required, with a low value of Dmin.

The samples 19 and 20 using overcoat layers 3 have further advantages in that matting effect of the image is more remarkable than in the other samples, and finger prints and other stains adhering to the surface are not clearly visible, thus permitting easy reading of the image.

What is claimed is:

1. A laser ablative recording material which has one or more layers including an inorganic particulate coloring agent layer on a surface of a support, wherein:

at least one layer from among said one or more layers including said coloring agent layer contains a nitric acid ester of carboxyalkyl cellulose having a degree of nitric acid ester group substitution per glucose anhydride unit within a range of from 0.05 to 2.8;

at least one layer from among said one or more layers including said coloring agent layer contains a material having absorption in the laser wavelength region;

an intermediate layer is provided between the coloring agent layer and the support, said intermediate layer containing cellulose nitrate; and a backcoat layer is provided on the support surface on a side opposite to the coloring agent layer, the outermost layer surface of said backcoat layer having a Beck smoothness of under 4,000 seconds.

2. The laser ablative recording material according to claim 1, wherein the inorganic particulate coloring agent of the inorganic particulate coloring agent layer has absorption in the laser wavelength region.

3. A laser ablative recording material which has one or more layers including an inorganic particulate coloring agent layer on a surface of a support, wherein:

at least one layer from among said one or more layers including said coloring agent layer contains a nitric acid ester of carboxyalkyl cellulose having a degree of nitric acid ester group substitution per glucose anhydride unit within a range of from 0.05 to 2.8;

at least one layer from among said one or more layers including said coloring agent layer contains a material having absorption in the laser wavelength region;

an overcoat layer is provided on the coloring agent layer, said overcoat layer containing tetrafluoroethylene beads; and a backcoat layer is provided on the support surface on a side opposite to the coloring agent layer, the outermost layer surface of said backcoat layer having a Beck smoothness of under 4,000 seconds.

4. The laser ablative recording material according to claim 3, wherein the inorganic particulate coloring agent of the inorganic particulate coloring agent layer has absorption in the laser wavelength region.

5. The laser ablative recording material according to any one of claims 1 or 3, further including an image-formed record prepared by irradiating a laser onto the laser ablative recording material.

6. The laser ablative recording material according to any one of claims, 1 or 3, further including an image-formed record prepared by providing a withstanding layer on the surface on the coloring agent layer side after irradiating a laser onto the laser ablative recording material.

7. The laser ablative recording material including said image-formed record according to claim 6, wherein said withstanding layer contains a polymerized organic material containing siloxane.

8. The laser ablative recording material including said image-formed record according to claim 6, wherein said withstanding layer has a thickness within a range of from 0.5 to 6 $\mu$m.

* * * * *